United States Patent [19]

Serizawa et al.

[11] Patent Number: 5,030,073

[45] Date of Patent: Jul. 9, 1991

[54] ROTARY COMPRESSOR

[75] Inventors: Yukio Serizawa; Koichi Sekiguchi; Yuukichi Nakada, all of Tochigi, Japan

[73] Assignee: Hitachi, Ltd., Tokyo, Japan

[21] Appl. No.: 510,856

[22] Filed: Apr. 18, 1990

[51] Int. Cl.[5] ..... F04C 18/356; F04C 29/02

[52] U.S. Cl. ..... 418/76; 418/94; 418/151

[58] Field of Search ..... 417/410; 418/63, 76, 418/94, 151

[56] References Cited

U.S. PATENT DOCUMENTS

| | | | |
|---|---|---|---|
| 4,710,111 | 12/1987 | Kubo | 418/151 X |
| 4,915,554 | 4/1990 | Serizawa et al. | 418/94 |

FOREIGN PATENT DOCUMENTS

| | | | |
|---|---|---|---|
| 59-107984 | 7/1984 | Japan . | |
| 63-131884 | 6/1988 | Japan | 418/63 |
| 63-223385 | 9/1988 | Japan | 418/94 |
| 2-86988 | 3/1990 | Japan | 418/94 |

*Primary Examiner*—Leonard E. Smith
*Assistant Examiner*—Eugene L. Szczecina, Jr.
*Attorney, Agent, or Firm*—Antonelli, Terry, Stout & Kraus

[57] ABSTRACT

A rotary compressor has a compression mechanism including main and sub bearings closing the ends of a cylinder bore and supporting a crankshaft having an eccentric portion on which a rolling piston positioned in the cylinder bore is rotatably mounted. Oil grooves are formed in the shaft holes of the bearings to receive lubrication oil from spaces defined by the rolling piston, the crankshaft eccentric portion and the main and sub bearings. The eccentric portion and the sub bearing are sized and shaped such that the oil groove in the sub bearing is always prevented from opening to the space adjacent thereto. The drawing force generated in the oil groove in the sub bearing by the rotation of a balancer attached to the lower end of the crankshaft is thereby prevented from acting on the space, thereby avoiding cavitation abrasion of the members facing the spaces.

8 Claims, 8 Drawing Sheets

ROTARY COMPRESSOR

BACKGROUND OF THE INVENTION

1. Field of the Invention

This invention relates generally to rotary compressors and, more particularly, to a rotary compressor which is designed as a sealed casing type for use in air conditoners, and which has improved durability in a high speed operation.

2. Description of the Prior Art

The prior art related to the present invention will be described below with reference to FIGS. 7 to 14.

In a rotary compressor shown in FIG. 7, an electric motor 1 and a compression mechanism 2 are housed in a sealed casing 14 and connected together by a crankshaft 10.

The electric motor 1 is housed in an upper portion of the internal space of the sealed casing 14. The electric motor 1 has a rotor la and a stator 1*b*. The crankshaft 10 is fitted into and fixed to the rotor 1*a* to drive the compression mechanism 2.

The compression mechanism 2 has a cylinder block 3 fixed to the sealed casing 14, a rolling piston 4 rotatably mounted on an eccentric portion 10*a* of the crankshaft 10 positioned in a cylinder bore 3*a* formed in the cylinder block 3, a vane 5 reciprocally movable following the revolution of the rolling piston 4, main and sub bearings 6 and 7 which close the cylinder bore 3*a* at the upper and lower ends thereof, respectively, and which support the crankshaft 10, a discharge valve 9 provided on the sub bearing 7, and a cover for the discharge valve 9.

As balancing weights (hereinafter referred to as "balancers") for cancelling the force produced by the eccentric rotation of the rolling piston 4, balancers 11-1, 11-2, and 11-3 are provided. The balancer 11-1 is attached to the end portion of the crankshaft 10 adjacent to the sub bearing 7, and the second and third balancers 11-2 and 11-3 are attached to the lower end and the upper end of the rotor 1*a*, respectively. A cover 12 is provided for the first balancer 11-1.

FIG. 8 is an enlarged cross-sectional view of the compression mechanism 2.

A longitudinal hole 21 is formed in the crankshaft 10 to enable lubrication oil 13 reservoired at the bottom of the internal space 14*a* of the sealed casing 14 to be supplied to the sliding members through an oiling piece 20. Small lateral holes 22-1, 22-2, and 22-3 are also formed in the crankshaft 10 so as to communicate with the longitudinal hole 21, thereby enabling the oil to be supplied to oil grooves 23-2 and 23-1 respectively formed in the inner circumferential surfaces of the main and sub bearings 6 and 7.

In the structure of the conventional compression mechanism, as shown in FIG. 9 which is a cross-sectional view taken along the line IX—IX in FIG. 8, a gap 26 is formed between a shaft hole 25 of the sub bearing 7 and a thrust surface 24 of the crankshaft 10 because the thrust surface 24 is eccentric with respect to the shaft hole 25.

This type of structure is disclosed in Japanese Utility Model Unexamined Publication No. 59-107984.

In the above-described prior art, the changes caused by the rotation of the first balancer 11-1 in the pressures in spaces 26-1 and 26-2 defined between the rolling piston 4, the eccentric portion 10*a* of the crankshaft 10 and the sub and main bearings 7 and 6 were not taken into consideration. The conventional mechanism will be described below in more detail with respect to this point.

FIGS. 11A to 11D show the movement of the gap 26 shown in FIG. 9 caused by the rotation of the crankshaft 10. Hatchings in FIGS. 11A to 11D indicate the thrust surface 24.

In the position shown in FIG. 11A, the thrust surface 24 does not cover the oil groove 23-1 at all. In the position shown in FIG. 11A, the crankshaft 10 is rotated clockwise to cause the thrust surface 24 to start covering the oil groove 23-1. In the position shown in FIG. 11C, the thrust surface 24 completely covers the oil groove 23-1. In the position shown in FIG. 11D, the thrust bearing 24 starts opening the oil groove 23-1.

FIG. 12 shows changes in the area (opening) of the oil groove 23-1 not covered with the thrust surface 24 during one revolution of the crankshaft 10. As can be understood from FIG. 12, the oil groove 23-1 is opened and closed one time during one revolution of the crankshaft 10 and this cycle is repeated.

FIG. 13A shows changes in the pressure in the space 26-1 shown in FIG. 8 during one revolution of the crankshaft 10 in a low speed operation, while FIG. 13B shows changes in the pressure in the same space during one crankshaft revolution in a high speed operation. In the low speed operation, as shown in FIG. 13A, the pressure variation $\Delta P_{Q1}$ is comparatively small. In the high speed operation, as shown in FIG. 13B, the pressure variation $\Delta P_{Q2}$ is substantially large.

The reason will be explained below with reference to FIG. 10. As the crankshaft 10 rotates, the first balancer 11-1 acts as a centrifugal pumping to move the lubrication oil 13 in the cover 12 in the directions of arrows A. By this movement, the lubrication oil in the spacer 26-1 is drawn downward through the oil groove 23-1 by the first balancer 11-1 as indicated by arrows B in FIG. 10 when the thrust surface 24 opens the oil groove 23-1 as shown in FIG. 11A and 11B. The lubrication oil in the spacer 26-1 is not drawn by the first balancer 11-1 when the thrust surface 24 closes the oil groove 23-1 as shown in FIG. 11C and 11D. Consequently, each time when the oil groove 23-*a* is opened by the thrust surface 24, the lubrication oil flows in the space 26-1. As the rotational speed of the crankshaft 10 is increased to a speed of about 8000 rpm or higher, the drawing force of the first balancer 11-1 abruptly increases. Accordingly, the pressure variation $\Delta P_{Q2}$ increases relative to the pressure variation $\Delta P_{Q1}$ exhibited during low speed operation.

As the pressure in the space 26-1 is repeatedly greatly changed alternating stresses are caused in the members which define the space 26-1, resulting in the occurrence of a phenomenon i.e., cavitation abrasions in which the materials of the members are partially removed. A surface 28 of the sub bearing 7 facing the space 26-1 was damaged by cavitation abrasion. This surface 28 was observed with an electron microscope. Striation patterns peculiar to fatigue failure were found in the inner surface of a recess formed by the removal of the material. The occurrence of cavitation abrasion was also observed in a surface 29 of the main bearing 6 which faces the space 26-2.

The main bearing 6 is formed of graphite flake cast iron while the sub bearing 7 is formed of sintered iron alloy. The occurrence of cavitation abrasion in the surface of the main bearing 6 indicates that the variation in the pressure in the space 26-2 on the side of the main bearing 6 is substantially large. It is thought that the variation in the pressure in the space 26-1 adjacent to the sub bearing 7 influences the pressure in the space 26-2 adjacent to the main bearing 6 through the oil groove 23-3.

As described above, the conventional compressor structure is deigned without any consideration of pressure variations caused by the operation and therefore entails a problem in terms of durability during a high speed operation.

SUMMARY OF THE INVENTION

The present invention has been made to solve the problems of the above-described conventional art and has an object to provide a rotary compressor in which the variations in the pressure in the spaces defined by the rolling piston, the eccentric portion of the crankshaft and the main and sub bearings are reduced to avoid cavitation abrasion thereby to improve the durability of the compressor.

A rotary compressor according to one aspect of the present invention includes a sealed casing in which lubrication oil is accumulated on its bottom, an electric motor and a compression mechanism both housed in the casing, and a crankshaft connecting the electric motor to the compression mechanism. The compression mechanism includes a cylinder block fixed in the casing and a main bearing and a sub bearing closing the ends of a cylinder bore in the cylinder block. The crankshaft is rotatably supported by bearing holes in the main and sub bearings. The crankshaft has an eccentric portion positioned in the cylinder bore. The compression mechanism further includes a rolling piston rotatably mounted on the eccentric portion and a vane reciprocally movable following the revolutions of the rolling piston. Balancer means are provides for cancelling the force of eccentric rotation of the rolling piston, the balancer means including a balancer at least attached to the crankshaft at one end of same on the side of the sub bearing. Lubrication means are provided for supplying the lubrication oil to a slide area between the eccentric portion and the rotary piston and to slide areas between the crankshaft and the main and sub bearings, the lubrication means including an oil groove at least formed in an inner circumferential surface of the shaft hole of the sub bearing through the overall length thereof. The balancer is positioned in the vicinity of the lower end of the oil groove. The rolling piston, the eccentric portion of the crankshaft and opposing end surfaces of the main and sub bearings cooperate to define spaces. The eccentric portion of the crankshaft and the sub bearing are sized and shaped such that the oil groove is always prevented from opening to one of the spaces adjacent to the sub bearing.

In accordance with one preferred embodiment of the present invention, the minimum distance between the periphery of a thrust surface of the eccentric portion of the crankshaft in contact with the sub bearing and the axis of the crankshaft is larger than the maximum distance between the oil groove in the sub bearing and the shaft axis.

In accordance with another embodiment of the present invention, the outer diameter of a sub shaft portion of the crankshaft supported by the sub bearing is smaller than the outer diameter of a main shaft portion of the crankshaft supported by the main bearing.

In accordance with still another embodiment of the present invention, the maximum distance between the oil groove in the sub bearing and the axis of the crankshaft is locally reduced at a point adjacent to the thrust surface of the crankshaft.

Preferably, a communication passage is formed in the eccentric portion of the crankshaft to provide a communication between the spaces and another communication passage is also formed in the main bearing to provide a communication between one of the spaces adjacent to the main bearing and a space between the sealed casing and the compression mechanism.

In accordance with the above feature of the present invention, the oil groove formed in the shaft hole in the sub bearing is always prevented from opening to the spaces defined by the rolling piston, the eccentric portion of the crankshaft and the main and sub bearings. Therefore, the drawing force produced by the rotation of the balancer attached to the lower end of the crankshaft does not act on the spaces, thereby reducing the possibility of cavitation caused in the case of the conventional compressor. The durability of the members facing the spaces is thereby improved to prolong the life of the compressor.

The above and other objects, features and advantages of the present invention will be made more apparent by the following description with reference to the accompanying drawings.

DESCRIPTION OF THE PREFERRED EMBODIMENTS

Figure 1:
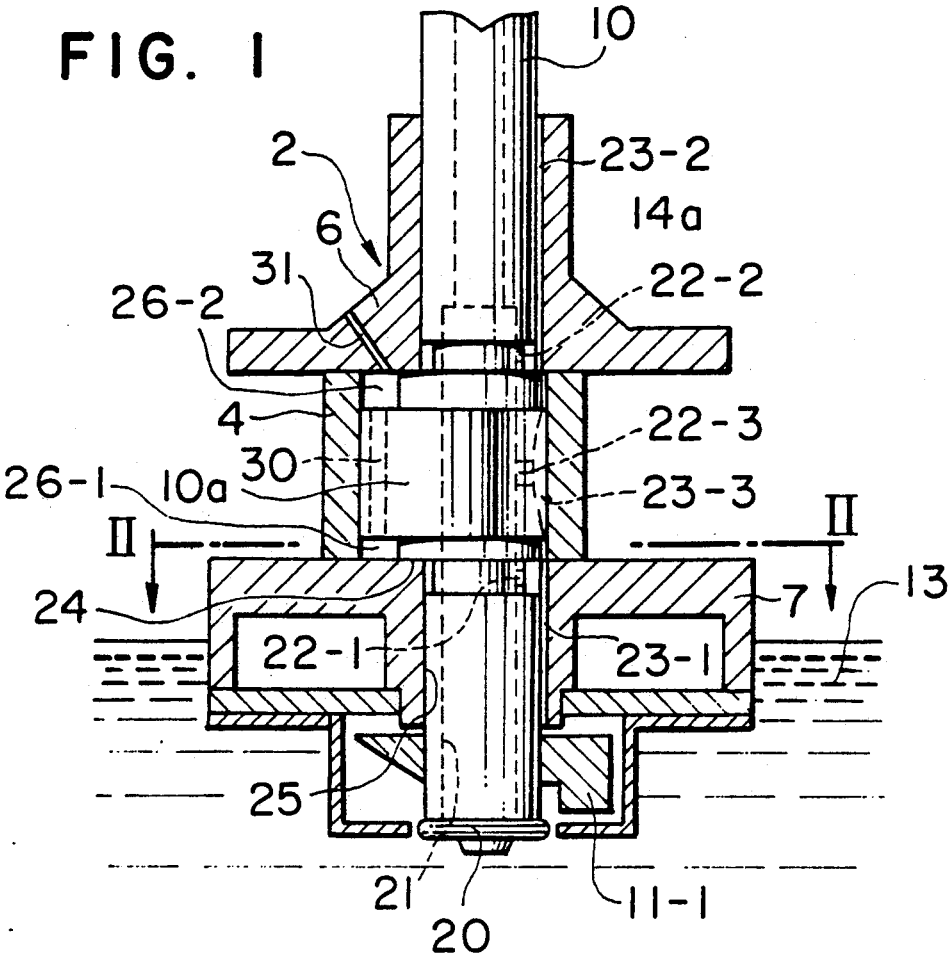
FIG. 1 is a cross-sectional view of a compression mechanism of a rotary compressor in accordance with an embodiment of the present invention.
Figure 2:
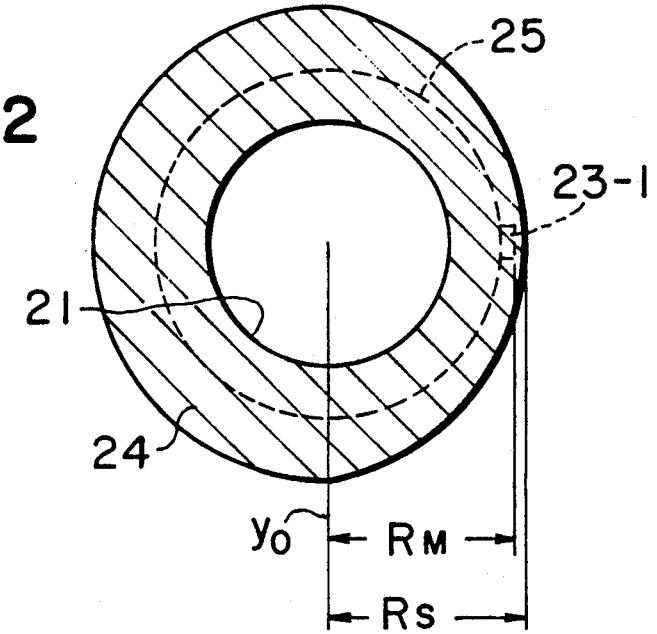
FIG. 2 is an enlarged cross-sectional view taken along the line II—II in FIG. 1.

Referring to FIGS. 1 and 2, in a compression mechanism 2 of a rotary compressor of an embodiment of the present invention, the shape of an eccentric portion **10*a* of a crankshaft 10 is determined such that the minimum radius $R_S$ of a thrust surface 24** of the eccentric portion 10a from an axis (center of rotation) $y_0$ thereof, which surface 24 contacts a sub bearing 7, is larger than the distance $R_M$ between the axis $y_0$ and the bottom of an oil groove 23-1 formed in the inner circumferential surface of a shaft hole 25 of the sub bearing 7.

Figure 7:
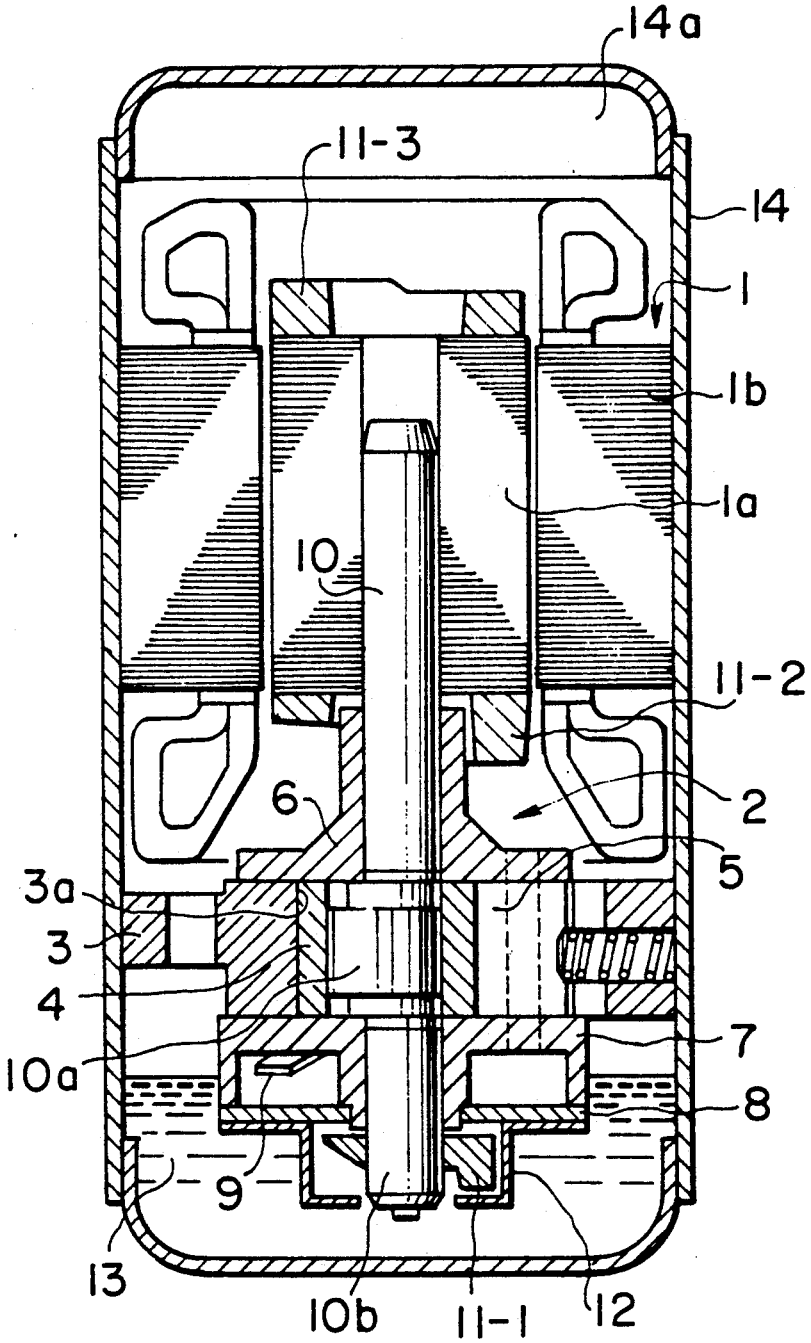
FIG. 7 PRIOR ART
FIG. 7 is a longitudinal cross-sectional view of a conventional rotary compressor.
Figure 8:
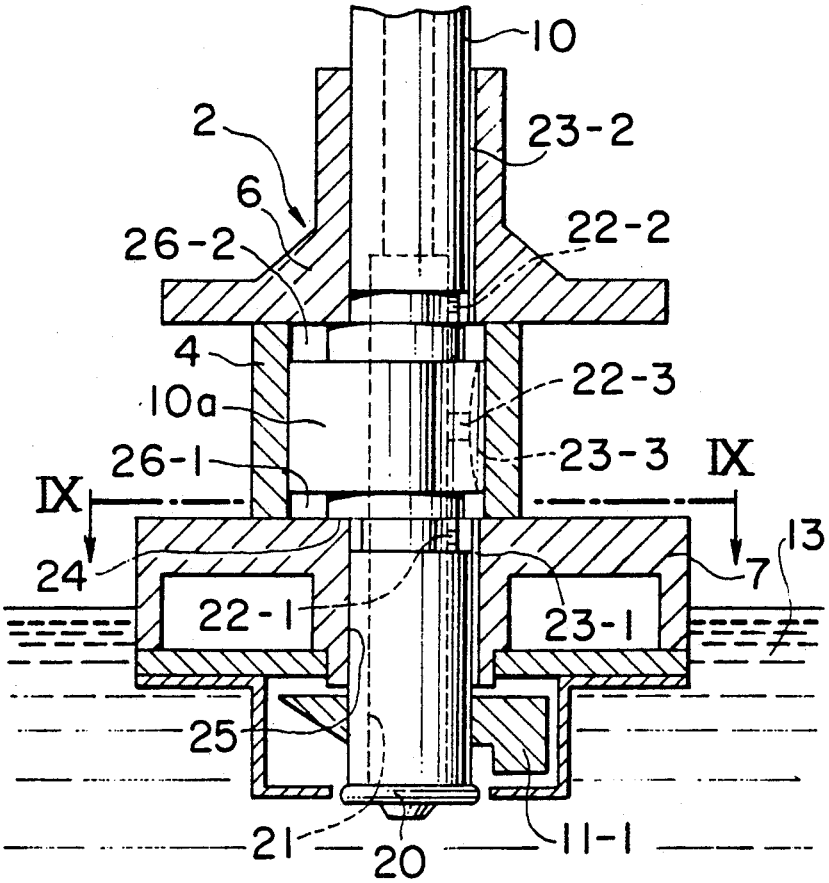
FIG. 8 PRIOR ART
FIG. 8 is a cross-sectional view of the compression mechanism of the compressor shown in FIG. 7.
Figure 9:
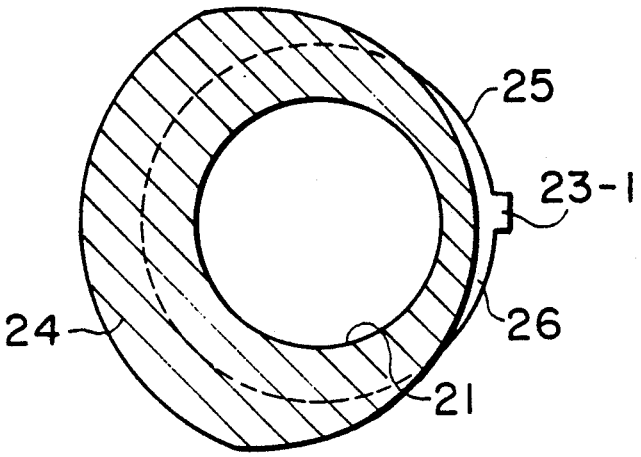
FIG. 9 PRIOR ART
FIG. 9 is a cross-sectional view taken along line IX—IX in FIG. 8.
Figure 10:
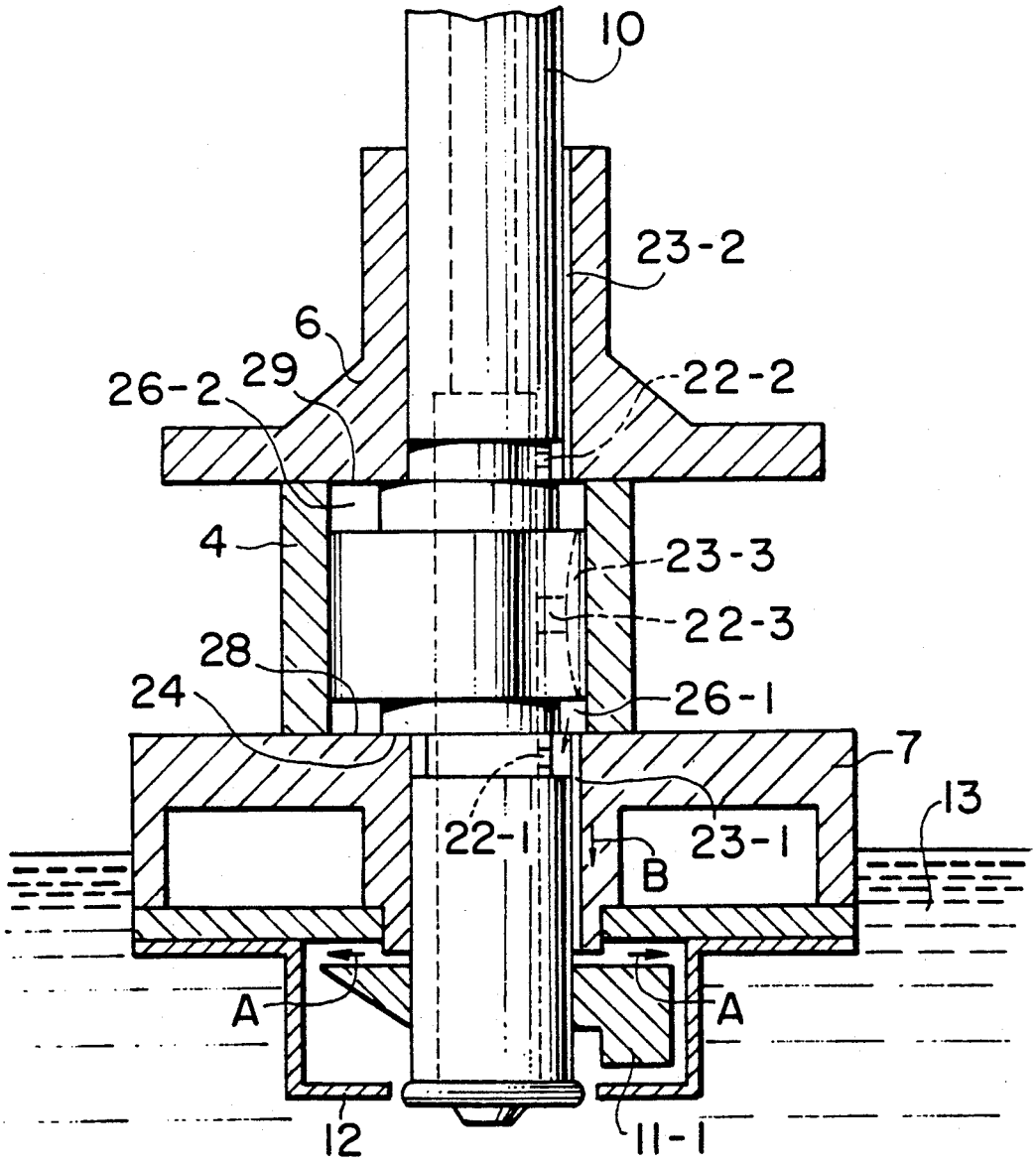
FIG. 10 PRIOR ART
FIG. 10 is an enlarged diagrammatic sectional view showing the operation of the compression mechanism shown in FIG. 8.
Figure 11A:
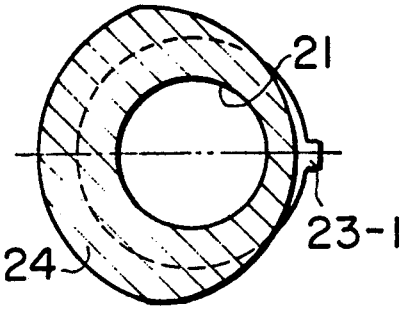
FIGS. 11A to 11D are diagrams showing the positional relationship between a thrust surface and an oil groove.
Figure 11B:
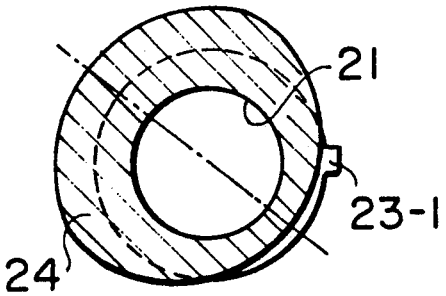
Figure 11C:
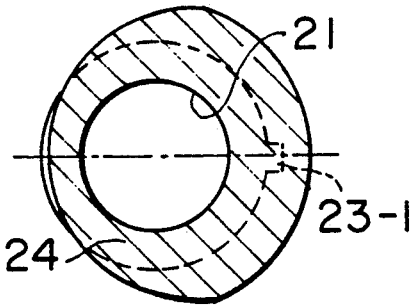
Figure 11D:
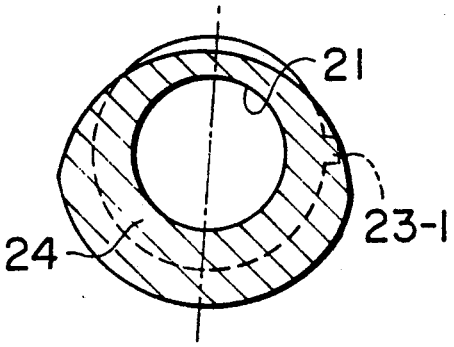
Figure 12:
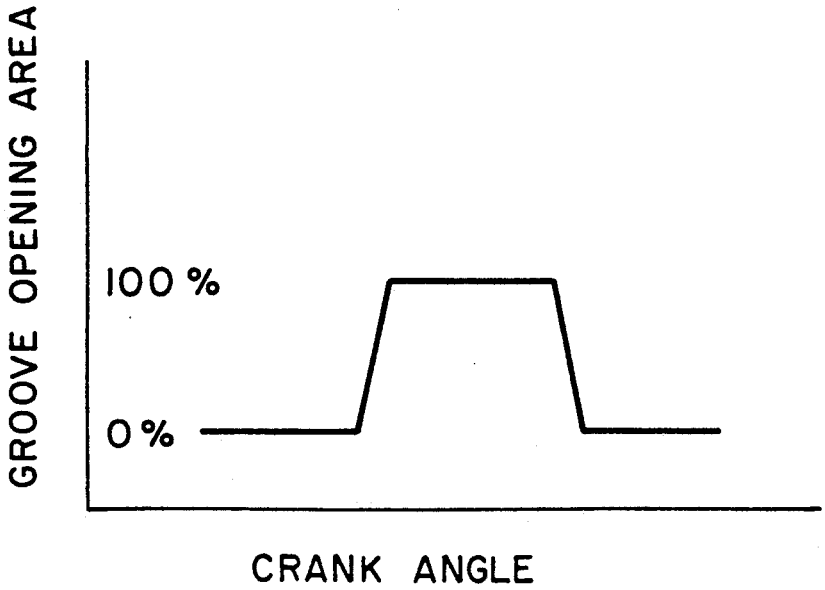
FIG. 12 graphically illustrates the change in the opening area of the groove in the compressor shown in FIG. 7.
Figure 13A:
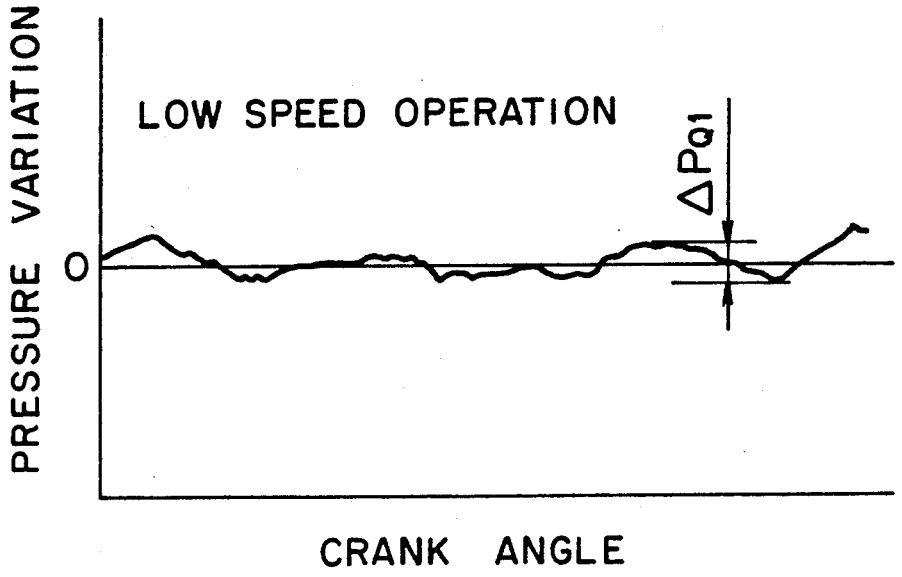
FIGS. 13A and 13B are diagrams showing the pressure variation in the compressor shown in FIG. 7.
Figure 13B:
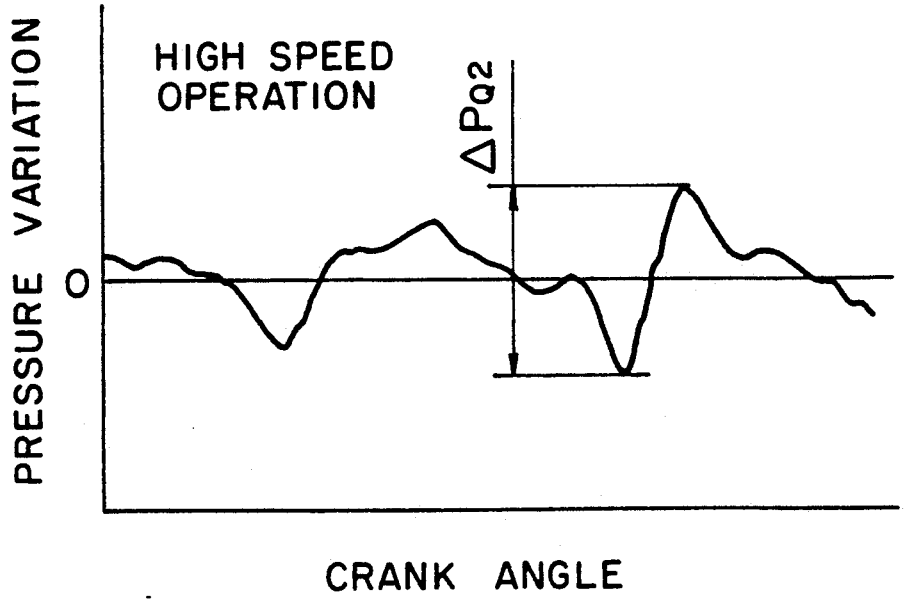

In addition, in the embodiment shown in FIG. 1, a communication passage 30 is formed in the eccentric portion 10a of the crankshaft 10 to provide a communication between spaces 26-1 and 26-2 defined by a rolling piston 4, the eccentric portion 10a and main and sub bearings 6 and 7, and a communication hole 31 is formed in the main bearing 6 to provide a communication between the space 26-2 defined between the main bearing 6, the rolling piston 4 and the eccentric portion 10a and a space 14a defined between a sealed casing 14 (refer to FIG. 7) and the compression mechanism 2.

The fundamental dimensions of an ordinary rotary compressor are determined as described below.

The capacity of the rotary compressor and the eccentricity of the crankshaft are given as the following equations:

$$V = \frac{\pi}{4}(D_C^2 - D_R^2)H_C$$

$$e = (D_C - D_R)/2$$

where V represents the capacity of the cylinder; $D_C$, the cylinder bore; $D_R$, the outside diameter of the rolling piston; $H_C$, the axial size of the cylinder bore; and e, the eccentricity of the crankshaft.

To change the cylinder capacity V, the cylinder bore $D_C$, the outside diameter $D_R$ of the rolling piston and the axial size $H_C$ of the cylinder bore may be changed. Ordinarily, for ease of manufacture, the outside diameter $D_R$ of the rolling piston and the eccentricity e of the crankshaft are changed while the axial size $H_C$ of the cylinder bore and the cylinder bore diameter $D_C$ are not changed. To increase the cylinder capacity V, the outside diameter $D_R$ of the rolling piston is reduced while the eccentricity e of the crankshaft is increased.

Figure 3:
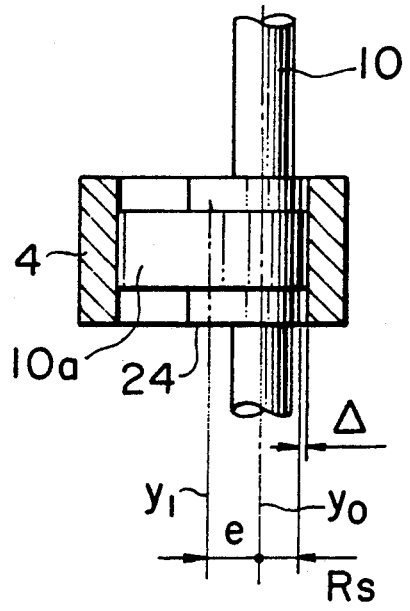
FIG. 3 is a diagrammatic illustration of an example of fitting of a rolling piston and a crankshaft.

Referring to FIG. 3, the axis of the crankshaft 10 is indicated by $y_0$ and the center of the eccentric portion 10a of the crankshaft is indicated by $y_1$. The distance e between the axes $y_0$ and $y_1$ is the eccentricity of the crankshaft. To fit the rolling piston 4 onto the eccentric portion 10a, a clearance Δ shown in FIG. 3 is required. Accordingly, the minimum radius $R_S$ of the thrust surface from the axis $y_0$ is restricted. Under these circumstances, in the conventional structure, the minimum radius $R_S$ is set to be smaller than the maximum distance $R_M$ between the axis $y_0$ and the bottom of the oil groove 23-a of the sub bearing 7.

In accordance with the present invention, structures described below are employed in order to prevent the oil groove 23-1 formed in the shaft hole 25 of the sub bearing 7 from communication with the space 26-1 adjacent to the sub bearing 7.

Figure 4:
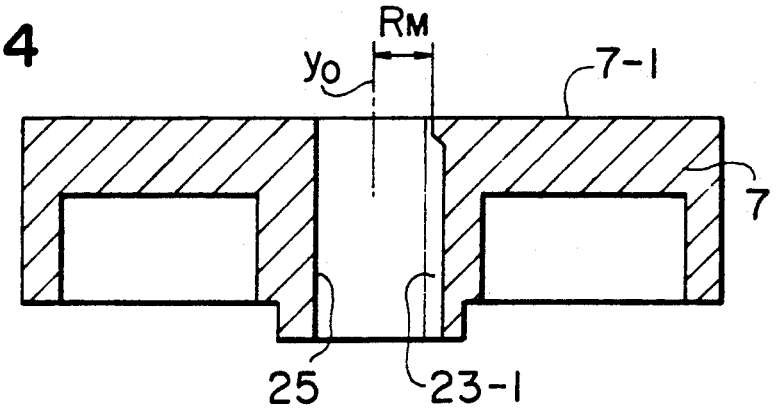
FIG. 4 is across-sectional view of an example of a sub bearing.

FIG. 4 shows an example of the sub bearing 7 in accordance with another embodiment of the present invention. The distance between the axis $y_0$ and the bottom of the oil groove 23-1 formed in the shaft hole 25 of the sub bearing 7 is locally reduced at an end 7-1 of the sub bearing 7 in contact with the thrust surface 24 of the crankshaft. That is, the depth of the oil groove 23-1 in the radial direction of the thrust surface 24 is reduced at the end 7-1 of the sub bearing 7.

Figure 5:
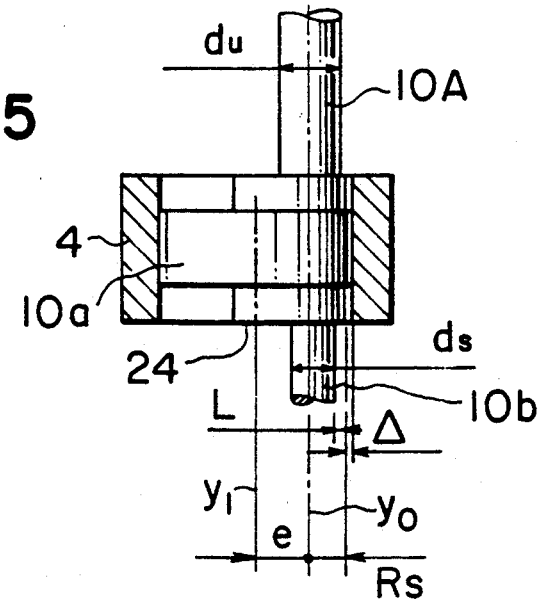
FIG. 5 is a diagrammatic illustration of a modification to the crankshaft.

Referring then to FIG. 5, a crankshaft 10A in accordance with a still another embodiment of the present invention is constructed such that the outer diameter ds of a sub shaft portion 10b which is to be supported on the sub bearing 7 is smaller than the outer diameter du of a main shaft portion 10A which is to be supported on the main bearing 6, so that a size L of a minimum width portion of the thrust surface 24 (the distance between the sub shaft portion 10b and the end of the thrust surface 24 defining the clearance Δ). Because the outside diameter of the sub shaft portion 10b and, hence, the diameter of the shaft hole 25 in the sub bearing 7 are reduced, the maximum distance $R_M$ between the axis $y_0$ and the bottom of the oil groove 23-1 formed in the inner circumferential surface of the shaft hole 25 is reduced.

Figure 6A:
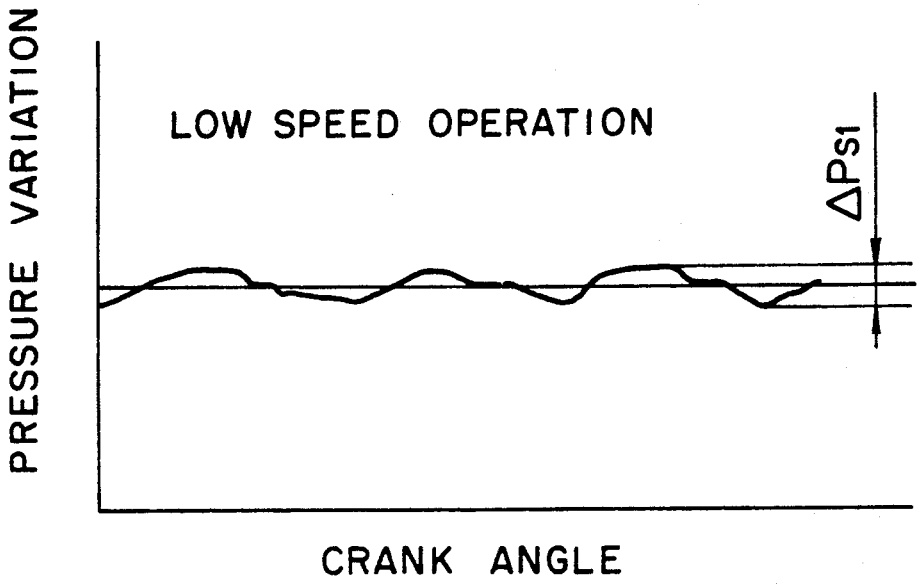
FIGS. 6A and 6B are diagrams showing the pressure variation in the compressor of the present invention.
Figure 6B:
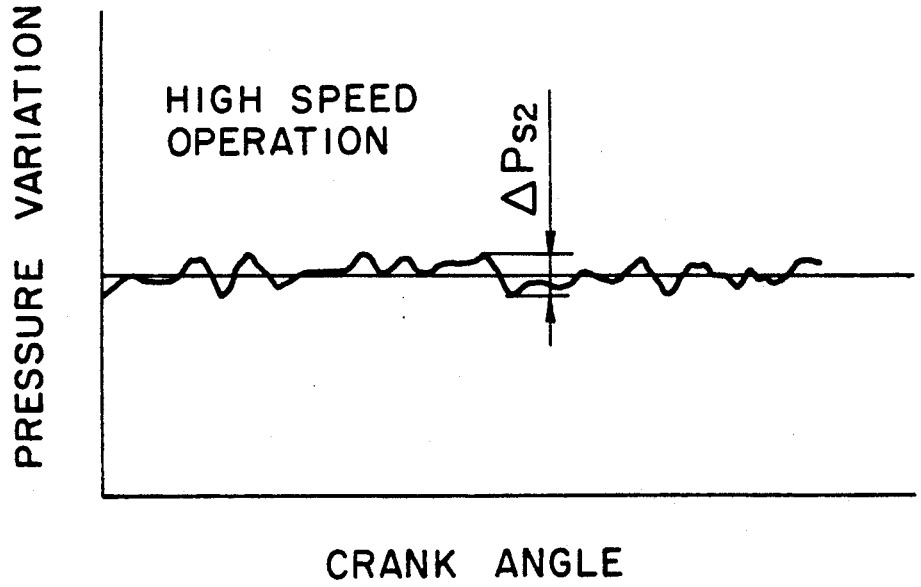

FIGS. 6A and 6B show the results of a test of the compressor in accordance with the embodiment of FIG. 4; FIG. 6A shows the variation in the pressure in the space 26-1 adjacent the sub bearing 7 during one revolution of the crank shaft 10 in a low speed operation, while FIG. 6B shows the corresponding pressure variation in a high speed operation. It is understood that the pressure variation $\Delta P_{S2}$ during the high speed operation shown in FIG. 6B is substantially equal to the pressure variation $\Delta P_{S1}$ during the low speed operation shown in FIG. 6A.

A durability operation test was also conducted to confirm the effects of this embodiment under the conditions under which cavitation abrasion took place in the conventional compressor. As a result, no abnormal abrasion was observed.

Further, in this rotary compressor, the communication passage 30 is formed in the eccentric portion 10a to provide a communication between the space 26-1 adjacent to the sub bearing 7 and the space 26-2 adjacent to the main bearing 6, while the communication passage 31 is formed in the main bearing 6, as shown in FIG. 1. The communications between the spaces 26-1 and 26-2 and between these spaces and the internal space 14a of the casing 14 also effectively contribute to the reduction in the variation of the pressure in the space 26-1 adjacent to the sub bearing 7 caused by the influence of the pumping action of the balancer 11-1, thus preventing the occurrence of cavitation abrasion.

As different embodiments of this invention may be made without departing from the spirit and scope thereof, it is to be understood that the invention is not limited to the specific embodiments.

What is claimed is:

1. A rotary compressor comprising:

a sealed casing in which lubrication oil is accumulated on its bottom;

an electric motor and a compression mechanism both housed in said casing;

a crankshaft connecting said electric motor to said compression mechanism;

said compression mechanism including a cylinder block fixed in said casing and a main bearing and a sub bearing closing a cylinder bore in said cylinder block at opposite ends thereof, said crankshaft being rotatably supported by shaft holes in said main and sub bearings, said crankshaft having an eccentric portion positioned in said cylinder bore, said compression mechanism further including a rolling piston rotatably mounted on said eccentric portion and a vane reciprocally movable following revolutions of said rolling piston;

balancer means for cancelling the force of eccentric rotation of said rolling piston;

said balancer means including at least one balancer attached to said crankshaft at one end thereof adjacent to said sub bearing;

lubrication means for supplying the lubrication oil to a slide area between said eccentric portion and said rotary piston and to a slide area between said crankshaft and said main and sub bearings;

said lubrication means including an oil groove formed at least in an inner peripheral surface of the shaft hole in said sub bearing through the overall length thereof;

said balancer being positioned in the vicinity of the lower end of said oil groove;

said rolling piston, said eccentric portion of said crankshaft and opposing end surfaces of said main and sub bearings cooperating together to define spaces; and said eccentric portion of said crankshaft and said sub bearing being sized and shaped such that said oil groove is always prevented from being opened to said spaces.

2. A rotary compressor according to claim 1, wherein the minimum distance between the outer periphery of a thrust surface of said eccentric portion of said crankshaft in contact with said sub bearing and the axis of said crankshaft is larger than the maximum distance between said oil groove of said sub bearing and the shaft axis.

3. A rotary compressor according to claim 1, wherein the outer diameter of a sub shaft portion of said crankshaft supported on said sub bearing is smaller than the outer diameter of a main shaft portion of said crankshaft supported on said main bearing.

4. A rotary compressor according to claim 1, wherein the maximum distance between said oil groove and the axis of said crankshaft is locally reduced at an end of said sub bearing adjacent to the thrust surface of said crankshaft.

5. A rotary compressor according to claim 1, wherein the outer diameter of a sub shaft portion of said crankshaft supported on said sub bearing is smaller than the outer diameter of a main shaft portion of said crankshaft supported on said main bearing and the maximum distance between said oil groove and the axis of said crankshaft is locally reduced at an end of said sub bearing adjacent to the thrust surface of said crankshaft.

6. A rotary compressor according to claim 1, further comprising:

a communication passage formed in said eccentric portion of said crankshaft to provide a communication between said spaces; and a communication passage formed in said main bearing to provide a communication between one of said spaces adjacent to said main bearing and a space formed between said sealed casing and said compression mechanism.

7. A rotary compressor comprising:

a sealed casing in which lubrication oil is accumulated on its bottom;

an electric motor and a compression mechanism both housed in said casing;

a crankshaft connecting said electric motor to said compression mechanism;

said compression mechanism including a cylinder block fixed in said casing and a main bearing and a sub bearing closing a cylinder bore in said cylinder block at opposite ends thereof, said crankshaft being rotatably supported by shaft holes in said main and sub bearings, said crankshaft having an eccentric portion positioned in said cylinder bore, said compression mechanism further including a rolling piston rotatably mounted on said eccentric portion and a vane reciprocally movable following revolutions of said rolling piston;

balancer means for cancelling the force of eccentric rotation of said rolling piston;

said balancer means including at least one balancer attached to said crankshaft at one end thereof adjacent to said sub bearing;

lubrication means for supplying the lubrication oil to a slide area between said eccentric portion and said rotary piston and to slide areas between said crankshaft and said main and sub bearings;

said lubrication means including a longitudinal oil supply hole formed in said crankshaft, lateral holes formed in said eccentric portion of said crankshaft and portions thereof adjacent to the end surfaces of said eccentric portion to communicate with said longitudinal oil supply hole, and an oil groove formed in an inner peripheral surface of the shaft hole of said sub bearing through the overall length thereof;

said balancer being positioned in the vicinity of the lower end of said oil groove;

said rolling piston, said eccentric portion of said crankshaft and opposing end surfaces of said main and sub bearings cooperating to define spaces adjacent to said main and sub bearings, respectively;

means for always preventing said oil groove from opening to one of said spaces adjacent to said sub bearing;

a communication passage formed in said eccentric portion of said crankshaft to provide a communication between said spaces; and a communication passage formed in said main bearing to provide a communication between one of said spaces adjacent to said main bearing and a space formed between said sealed casing and said compression mechanism.

8. A rotary compressor comprising:

a sealed casing in which lubrication oil is accumulated on its bottom;

an electric motor and a compression mechanism both housed in said casing;

a crankshaft connecting said electric motor to said compression mechanism;

said compression mechanism including a cylinder block fixed in said casing and a main bearing and a sub bearing closing a cylinder bore of said cylinder block at opposite ends thereof, said crankshaft being rotatably supported by shaft holes of said main and sub bearings, said crankshaft having an eccentric portion positioned in said cylinder bore, said compression mechanism further including a rolling piston rotatably mounted on said eccentric portion and a vane reciprocally movable following the revolutions of said rolling piston;

balancer means for cancelling the force of eccentric rotation of said rolling piston;

said balancer means including a balancer attached to said crankshaft at one end thereof adjacent to said sub bearing;

lubrication means for supplying the lubrication oil to a slide area between said eccentric portion and said rotary piston and to slide areas between said crankshaft and said main and sub bearings;

said lubrication means including a longitudinal oil supply hole formed in said crankshaft, lateral holes formed in said eccentric portion of said crankshaft and portions thereof in the vicinity of end surfaces of said eccentric portion to communicate with said longitudinal oil supply hole, and an oil groove formed in an inner peripheral surface of the shaft hole of said sub bearing through the overall length thereof;

said balancer being positioned in the vicinity of the lower end of said oil groove;

said rolling piston, said eccentric portion of said crankshaft and end surfaces of said main and sub bearings cooperating to define spaces adjacent to said main and sub bearings, respectively;

said eccentric portion of said crankshaft and said sub bearing being sized and shaped such that said oil groove is always prevented from opening to said space;

a communication passage formed in said eccentric portion of said crankshaft to provide a communication between said spaces; and a communication passage formed in said main bearing to provide a communication between one of said spaces adjacent to said main bearing and a space formed between said sealed casing and said compression mechanism.

* * * * *